US005477674A

United States Patent [19]

Somers et al.

[11] Patent Number: 5,477,674

[45] Date of Patent: Dec. 26, 1995

[54] UNDERWATER HYDRAULIC SYSTEM FOR REDUCING PUMP NOISE

[75] Inventors: George W. Somers, Severna Park; John E. Doucette, Stevensville, both of Md.

[73] Assignee: Westinghouse Electric Corporation, Pittsburgh, Pa.

[21] Appl. No.: 354,930

[22] Filed: Dec. 12, 1994

[51] Int. Cl.[6] ..... B63G 8/00; F16D 31/02

[52] U.S. Cl. ..... 60/415; 60/418; 114/312

[58] Field of Search ..... 91/9 R; 60/325, 60/415, 418, 408, 459; 114/312, 318, 319

[56] References Cited

U.S. PATENT DOCUMENTS

| | | | |
|---|---|---|---|
| 3,100,965 | 8/1963 | Blackburn | 60/413 X |
| 3,903,696 | 9/1975 | Carman | 60/414 |
| 3,985,063 | 10/1976 | Lemon | 60/413 X |
| 4,471,806 | 9/1984 | Strock | 60/413 X |
| 4,630,441 | 12/1986 | Chamberlain | 60/413 |

FOREIGN PATENT DOCUMENTS

| | | | |
|---|---|---|---|
| 0360370 | 3/1990 | European Pat. Off. | 114/319 |

*Primary Examiner*—Edward K. Look
*Assistant Examiner*—Hoang Nguyen

[57] ABSTRACT

A hydraulic system which includes a pump for supplying hydraulic fluid to a load by a fluid supply line and receiving hydraulic fluid from the load by means of a fluid return line. The pump, as well as a drive motor therefore is enclosed within a pressure vessel, having a gas interior which forms an acoustic impedance mismatch so that the pump is acoustically isolated from the surrounding water medium. The fluid return line is connected to a reservoir having a moveable piston which separates the reservoir into two compartments, one filled with oil and the other with gas. The reservoir is sealed so that its internal pressure which is relatively low, for example between 10 and 100 psia is completely independent of the pressure of the surrounding water medium and maintains the return line pressure at that same low value.

8 Claims, 4 Drawing Sheets

UNDERWATER HYDRAULIC SYSTEM FOR REDUCING PUMP NOISE

BACKGROUND OF THE INVENTION

1. Field of the Invention

The invention in general relates to hydraulic fluid supplies, and more particularly to an arrangement used in the underwater environment at shallow to moderate depths and wherein a pump supplies hydraulic fluid to a load.

2. Description of Related Art

Various underwater vehicles have hydraulically activated mechanisms which require the supply of a hydraulic fluid. The hydraulic fluid is supplied by a motor driven pump which has a supply line and a return line wherein the return line pressure is controlled by the ambient sea pressure and the supply pressure is a fixed differential pressure above the return pressure.

The pump may be carried on the outside of the vehicle or in a free flooded compartment within the vehicle and in order to reduce pump noise radiation to the surrounding water medium, and to protect the pump body and shaft seal from seeing an excessive differential pressure, a double enclosure acoustic isolation arrangement is provided.

In such arrangement, the pump/motor unit is placed within a first pressure vessel filled with hydraulic fluid at the return line pressure and this pressure vessel in turn is enclosed within a second and larger pressure vessel filled with a gas at a nominal pressure of one atmosphere.

Although radiated pump noise is significantly reduced, the arrangement is bulky, heavy and difficult to make and assemble.

An improved system for reducing radiated pump noise is described and claimed in co-pending application Ser. No. 232907 filed Apr. 25, 1994, and assigned to the same assignee as the present invention. In that improvement, the dual pressure vessel arrangement is replaced by a single pressure vessel, the interior of which is maintained at a predetermined pressure by means of a gas supply and pressure regulator. The pressure within the return line, as well as operation of the regulator, is controlled by a reservoir having a piston and rod arrangement acted upon by the ambient water pressure.

Such arrangement is capable of deep diving operations such as 20,000 feet. The present invention eliminates the gas pressurization arrangement and is ideally suited for operation at shallower depths utilizing the same pump characteristics for the deeper diving system.

SUMMARY OF THE INVENTION

An improved hydraulic system is provided for use in an underwater structure such as an underwater vehicle wherein a pump supplies hydraulic fluid to a load. The arrangement includes a pressure vessel carried by the structure and exposed to the surrounding ambient water medium. A motor-driven pump is located within the pressure vessel and emanating from the pump is a hydraulic fluid supply line which connects the pump to the load with the hydraulic circuit being completed back to the pump by means of a hydraulic fluid return line. A reservoir is provided which has a moveable partition separating the interior of the reservoir into a fluid side and a gas side and being sealed such that the pressure of the fluid and the pressure of the gas within the reservoir are equal and independent of the pressure of the surrounding water medium. A fluid line connects the fluid side of the reservoir to the fluid return line so as to maintain the pressure of the hydraulic fluid in the fluid return line substantially at the same pressure as the pressure within the reservoir.

DESCRIPTION OF THE PREFERRED EMBODIMENTS

Figure 1:
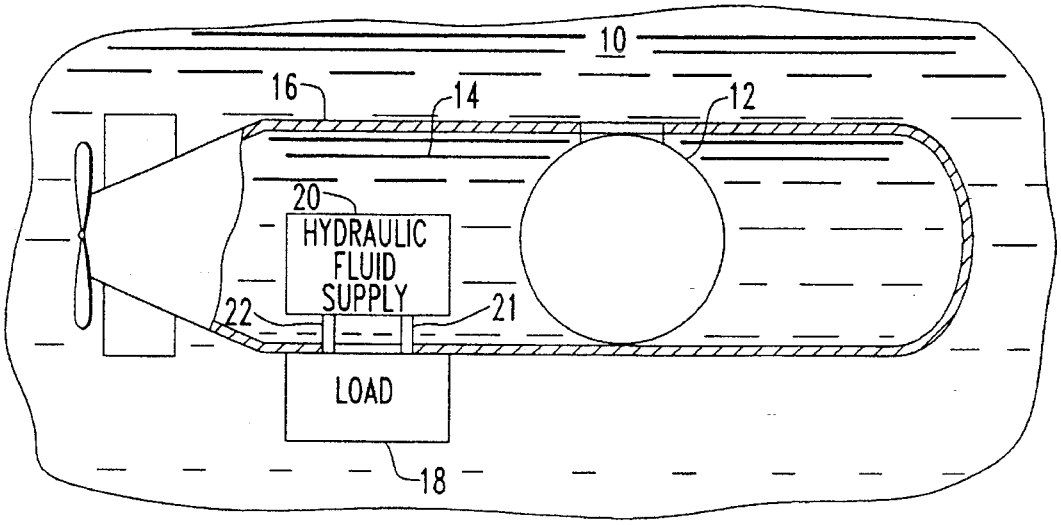
FIG. 1 is a view of an underwater vehicle in which the present invention finds application.

Although the invention is applicable with a variety of underwater structures, it will be described by way of example with respect to an underwater vehicle such as illustrated in FIG. 1. The underwater vehicle 10 includes a pressure hull 12 forming a one atmosphere compartment for a crew and surrounded by a free-flooded area 14 contained by the vehicle shell 16.

The vehicle carries a load 18 which may include valves and actuators for various mechanisms such as mechanical arms. The actuators are hydraulically operated and accordingly a hydraulic fluid supply 20 within the free-flooded area 14 supplies hydraulic fluid to the load by means of a supply line 21 and hydraulic fluid is returned from the load by means of return line 22. The hydraulic fluid supply includes a motor driven pump, the radiated noise from which must be minimized.

Figure 2:
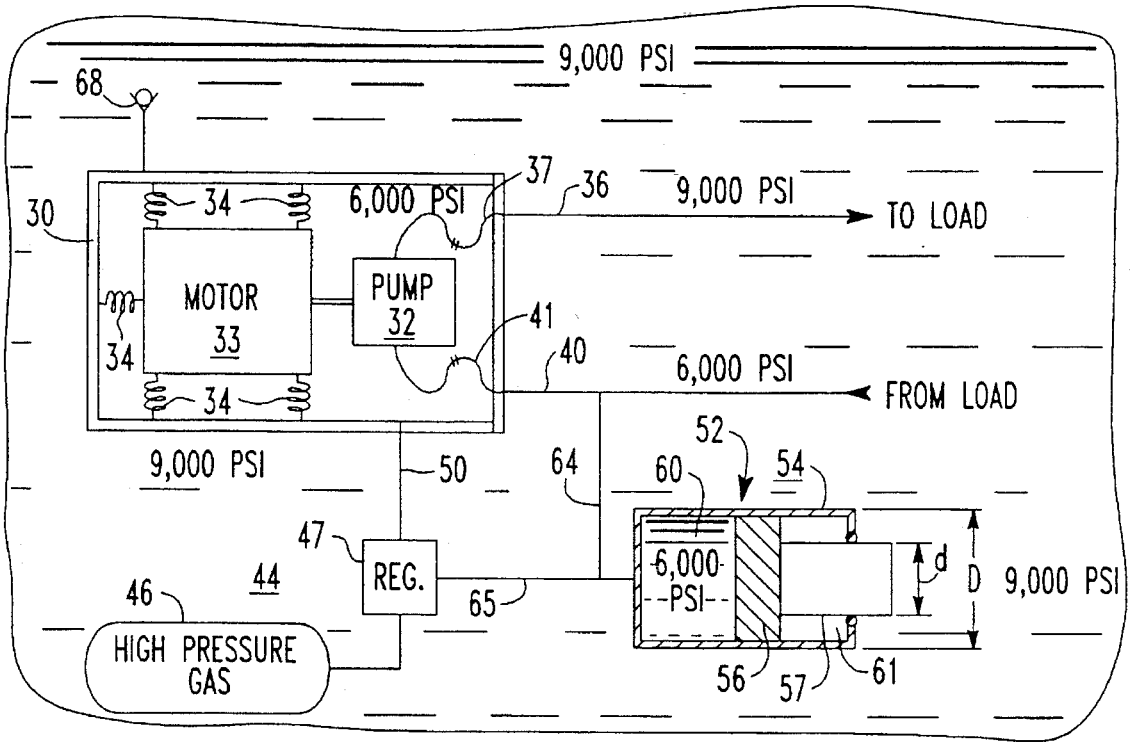
FIG. 2 PRIOR ART
FIG. 2 is a schematic diagram of an improved hydraulic supply system of the prior art.

Referring now to FIG. 2 illustrating the arrangement described and claimed in the aforementioned application, the apparatus includes a single pressure vessel 30 containing the pump 32 driven by motor 33 carried by vibration isolation mounts 34. The pump 32 supplies hydraulic fluid to hydraulic fluid supply line 36 via a single flexible fluid line 37 and the high pressure fluid is supplied to the load (not shown). Fluid return is accommodated by hydraulic fluid return line 40 connecting to the input of pump 32 by means of flexible fluid line 41. Various pressures are illustrated in the drawing by way of example for an operational depth where the ambient water pressure is 9,000 psi (approximately 20,270 feet in seawater).

A gas supply 44 is provided for pressurizing the interior of vessel 30 to a predetermined value, as will be described. The gas supply includes a source of high pressure gas 46 and a pressure regulator 47 connected to the interior of pressure vessel 30 by means of a gas line 50.

Means 52 are provided for maintaining the pressure of the fluid within return line 40 at a predetermined fraction of the pressure of the ambient water medium. This is accomplished by means of a reservoir 54 which contains a piston and rod assembly comprised of piston 56 and rod 57 with the piston dividing the reservoir 54 into a first compartment 60 containing hydraulic fluid, and second compartment 61 containing a gas at relatively low pressure, for example 15–100 psi so that its effect on the return line pressure is negligible.

A first fluid line 64 connects compartment 60 with the return line 40 and a second fluid line 65 operating as a sensing line functions, in conjunction with regulator 47 to maintain the gas pressure supplied to pressure vessel 30 equal to the return line pressure.

The pressurization of the return line (as well as the interior of vessel 30) to a value which is a fraction of the ambient water pressure is accomplished by the design of the piston and rod assembly. By way of example, let it be assumed that the piston and rod are circular cylinders having respective diameters of "d" for rod 57 and "D" for piston 56. The diameters are so selected such that the ratio of the axial cross sectional areas of the rod to piston is the predetermined fraction desired. If the cross sectional area of rod 57 is "a" and that of piston 56 is "A" and if the system is to be pressurized to a value of ⅔ of the ambient water pressure, then:

$$a/A=\tfrac{2}{3}$$

The area on which the ambient water pressure acts is ⅔ of the area on which the hydraulic pressure acts thus controlling the return line pressure.

For a depth as previously described by way of example where the ambient pressure is 9,000 psi, with an a-to-A ratio of ⅔, the pressure of hydraulic fluid within first compartment 60 is 6,000 psi as is the return line pressure. The pressure in compartment 60 is communicated to regulator 47 such that the interior of pressure vessel 30 is maintained at a value of 6,000 psi resulting in a pressure differential across the walls of the pressure vessel of only 3,000 psi as opposed to 9,000 psi if the interior were not pressurized.

The pump supply pressure is 3,000 psi over that of the return and accordingly hydraulic fluid in supply line 36 is at a pressure of 9,000 psi. As the apparatus ascends from the deep water depths, the ambient water pressure decreases. Accordingly, a vent 68 is connected to the interior of pressure vessel 30 in order to relieve the pressure therein as the pressure values reduce.

Figure 3:
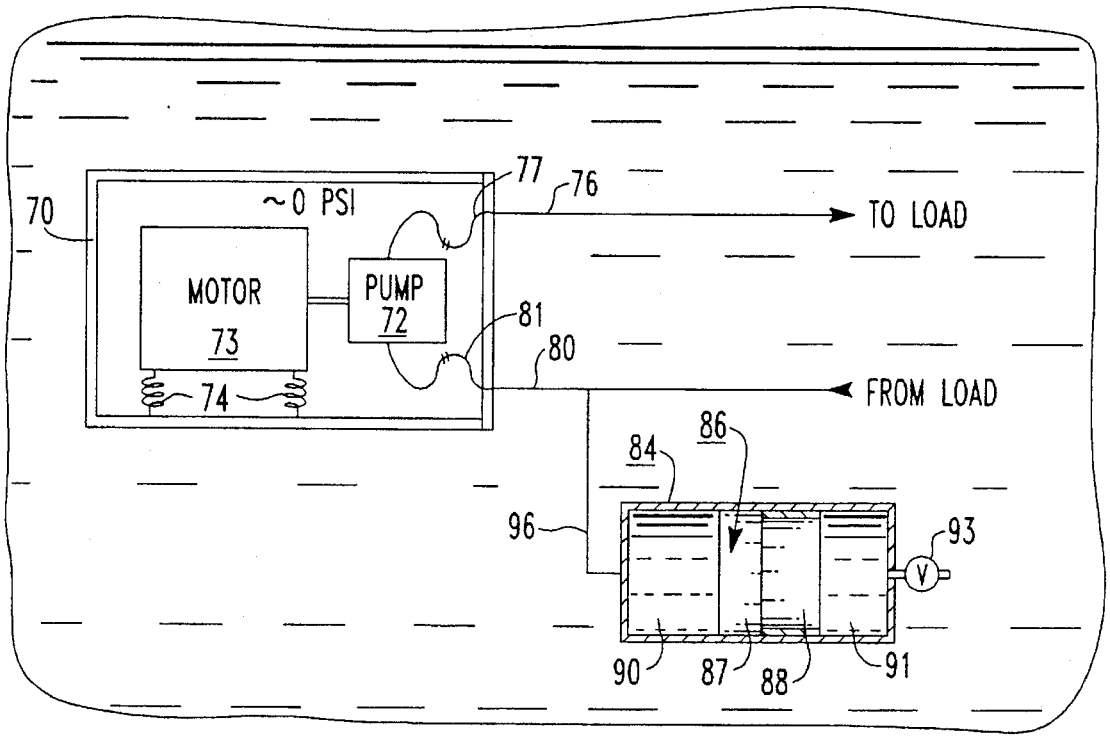
FIG. 3 is a schematic of an hydraulic system in accordance with the present invention.

With the present invention, one embodiment of which is illustrated in FIG. 3, the gas supply pressure regulator and its fluid connections may be eliminated with a sacrifice in deep-depth operation, with the depth limit being determined by the differential pressure capabilities of various seals.

In FIG. 3, a single pressure vessel 70 contains the pump 72 driven by motor 73 carried by vibration isolation mounts 74. The interior of pressure vessel 70 contains a gas, for example air, that is nominally at atmospheric pressure, with the gas forming an acoustic impedance mismatch to minimize pump airborne noise radiated into the surrounding ambient water medium. Transmission of vibration and noise is also reduced with the provision of the vibration isolation mounts 74.

The pump 72 supplies hydraulic fluid to hydraulic fluid supply line 76 via a single flexible fluid line 77 and the high pressure fluid is supplied to a load. Fluid return from the load is accommodated by hydraulic fluid return line 80 connecting to the input of pump 72 by means of flexible fluid line 81.

A reservoir 84 is provided for maintaining the pressure in the fluid return line 80, and accordingly at the inlet of pump 72, at a relatively low value compared to the ambient pressure of the water medium at operating depth. The reservoir has a moveable partition in the form of a piston assembly 86 which in one embodiment is comprised of a solid cylindrical piston portion 87 with an attached or integral hollow cylinder 88. The piston assembly 86 divides the reservoir 84 into a fluid side 90 filled with hydraulic fluid, and a gas side 91 which may be pressurized to a relatively low value by means of gas valve 93. The fluid side 90 of reservoir 84 is connected to the fluid return 80 by means of fluid line 96.

The reservoir accommodates changes in the volume of the oil in the system due to expansion and contraction resulting from temperature changes and also due to load usage. By virtue of the fluid communication via fluid line 96, the pressure in the fluid return line 80 is the same as the pressure within reservoir 84. Although the gas pressure in the reservoir is chosen to be small compared to the supply pressure, it must be large enough so that the pump 72 does not cavitate and pull a vacuum such that the hydraulic pump cavities causing the fluid to vaporize. This minimum pressure at the input of pump 72 may by way of example being the order of 10 to 25 psia.

Figure 4:
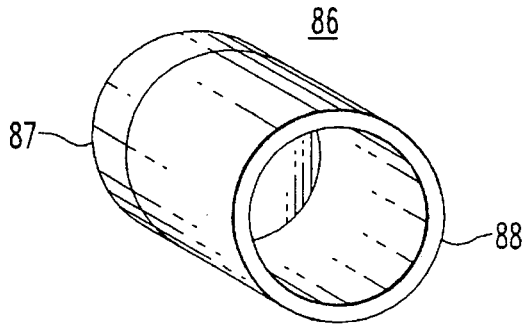
FIG. 4 is a view of the piston located within the reservoir of FIG. 3.
Figure 5A:
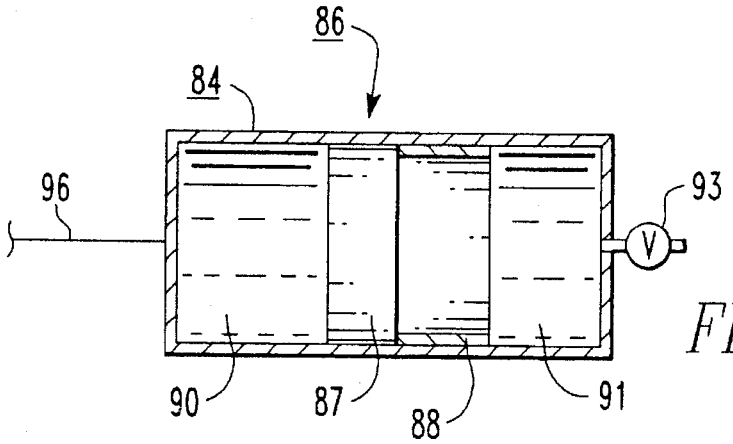
FIGS. 5A and 5B are views, partially in section, of the piston of FIG. 4 at two positions within the reservoir.
Figure 5B:
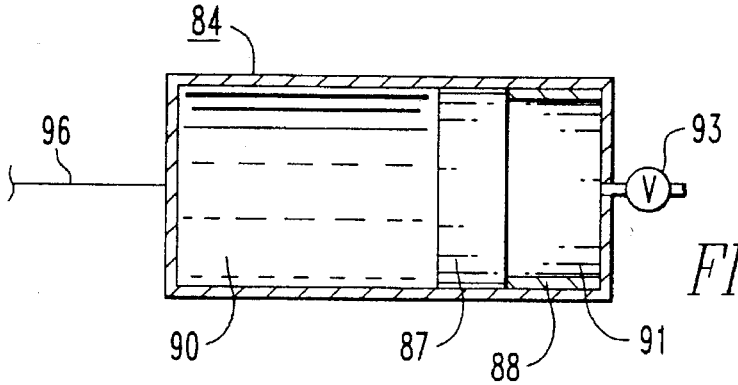

As the reservoir 84 fills and empties with hydraulic fluid, the gas pressure changes as the volume changes, but these changes are relatively small. For example, the gas pressure could be set to one atmosphere when the reservoir is empty and when the reservoir is full, the gas pressure might be several atmospheres but probably less than 100 psi. The maximum pressure is limited by the presence of hollow cylinder 88. The piston assembly 86 is further illustrated in FIG. 4 and is seen that the integral assembly is a right circular cylinder. The piston assembly 86 is shown in a mid-position in FIG. 5A and in an extreme right-hand position in FIG. 5B. The presence of hollow cylinder 88 prevents the piston 87 from further travel and accordingly from further compression of the gas in gas compartment 91 which would allow an increase in the pressure.

Figure 6:
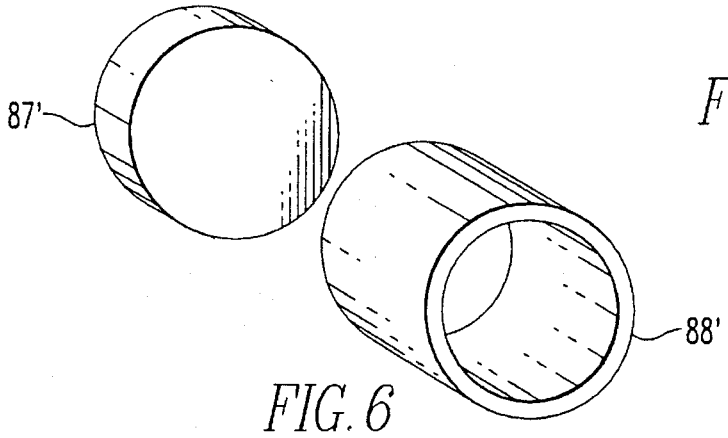
FIG. 6 illustrates an alternate piston assembly.
Figure 7:
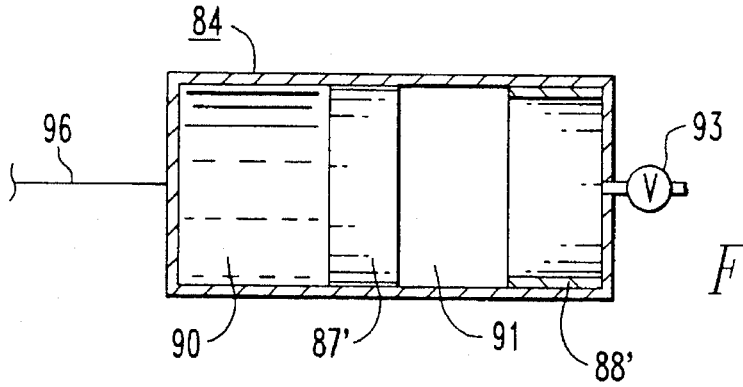
FIG. 7 illustrates the alternate piston assembly of FIG. 6 within the reservoir.

FIG. 6 illustrates an alternate arrangement for a piston assembly comprised of two distinct sections: a solid cylindrical piston 87' and a hollow cylinder 88' The hollow cylinder 88' may be set at the right most end of the reservoir 84 as illustrated in FIG. 7 to serve as a stop for further movement of the piston member 87'.

Figure 8:
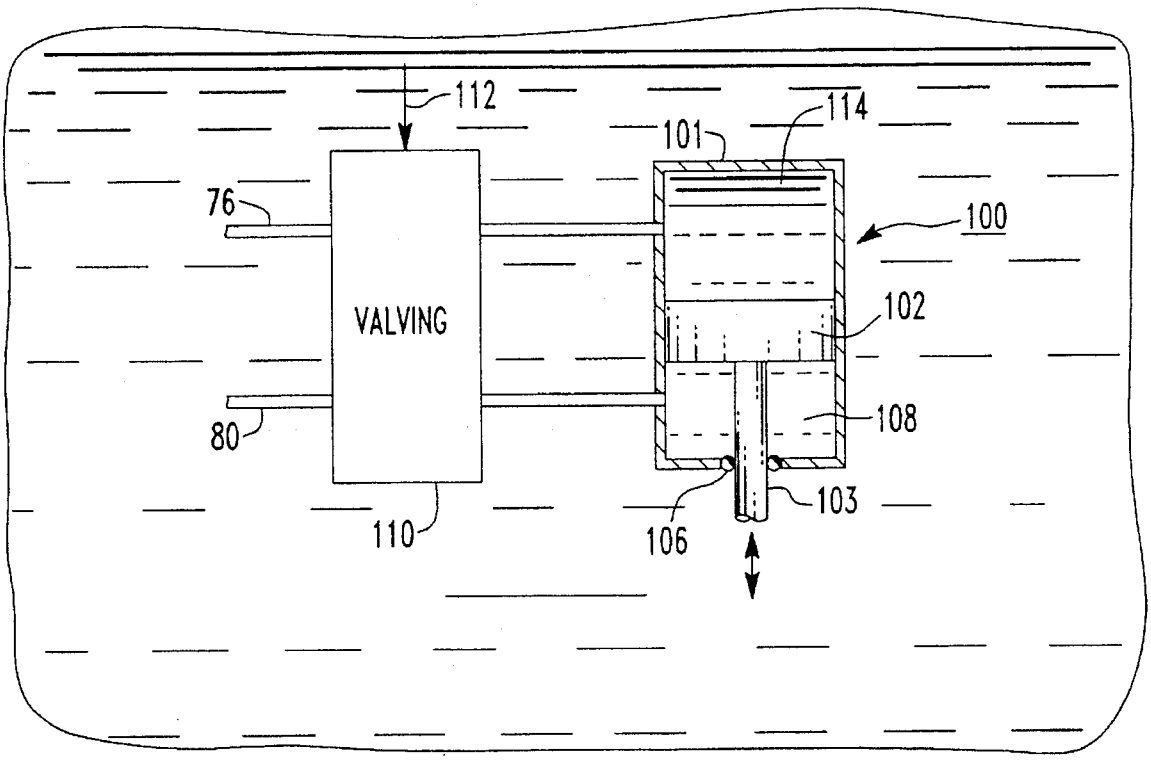
FIG. 8 is a simplified schematic representation of a typical load device.

FIG. 8 illustrates a simplified schematic of a typical load. The load includes an actuator 100 having an actuator body 101 containing a moveable piston 102 with a connected rod 103 for performing a predetermined function. The rod 103 passes through a ring seal 106 which prevents entry of the surrounding water medium into the lower portion 108 of the actuator 100.

In operation, valving circuitry 110 may receive a command on line 112 to direct hydraulic fluid in supply line 76 to either the upper portion 114 or lower portion 108 of the actuator 100.

When the supply line 76 is connected to the upper portion 114, the lower portion 108 is connected to the fluid return line 80 in which instance the pressure in lower portion 108 may be substantially less than ambient pressure. Ring seal 106 must be able to withstand the pressure differential and may be a limiting factor in maximum depth excursions. Ring seals which can withstand a pressure differential in the order of 3,000 psi are routinely available which would dictate a maximum operational depth of close to 7,000 feet.

We claim:

1. An hydraulic system for use in an underwater structure wherein hydraulic fluid is supplied to a load, comprising:

a) a pressure vessel carried by said structure and exposed to the surrounding water medium;

b) a pump and drive motor therefore contained within said pressure vessel, said pump having an output and an input;

c) an hydraulic fluid supply line connecting the output of said pump to said load;

d) an hydraulic fluid return line connecting said load back to the input of said pump;

e) a reservoir having a moveable partition therein separating the interior of said reservoir into a fluid side and a gas side and being sealed such that the pressure of the fluid and the pressure of the gas within said reservoir are equal and independent of the pressure of the surrounding water medium;

f) a fluid line connecting said fluid side of said reservoir to said fluid return line so as to maintain the pressure of the hydraulic fluid in said fluid return line substantially at the same pressure as the pressure within said reservoir.

2. Apparatus according to claim 1 which includes:

a) means for limiting the maximum gas pressure in said reservoir.

3. Apparatus according to claim 1 wherein:

a) said reservoir includes a gas valve for initially pressurizing the interior of said reservoir.

4. Apparatus according to claim 1 wherein:

a) the minimum pressure within said reservoir during operation is no less than about 10 psia.

5. Apparatus according to claim 1 wherein:

a) said moveable partition is a piston assembly.

6. Apparatus according to claim 5 wherein:

a) said piston assembly includes a solid cylindrical portion and a hollow cylindrical portion, said hollow cylindrical portion forming said gas side of said reservoir if said piston assembly is forced to one extreme of travel against an end portion of said reservoir.

7. Apparatus according to claim 6 wherein:

a) said solid cylindrical portion and said hollow cylindrical portion are integrally joined for movement together.

8. Apparatus according to claim 1 wherein:

a) said moveable partition is a piston; and which includes b) means for limiting movement of said piston to prevent it from contacting an end portion of said reservoir.

* * * * *